United States Patent [19]

Lovett

[11] 4,049,933

[45] Sept. 20, 1977

[54] ELECTRICAL SHORTING DEVICE

[76] Inventor: Jack R. Lovett, 1900 Irving, Orange, Tex. 77630

[21] Appl. No.: 597,305

[22] Filed: July 18, 1975

[51] Int. Cl.[2] ..... H01H 31/00

[52] U.S. Cl. ..... 200/48 R

[58] Field of Search ..... 200/48 R, 48 P, 48 A, 200/48 KB, 144 R; 337/199

[56] References Cited

U.S. PATENT DOCUMENTS

| | | | |
|---|---|---|---|
| 607,251 | 7/1898 | Lewis | 317/66 |
| 2,003,298 | 6/1935 | Lemmon | 337/32 |
| 2,272,370 | 2/1942 | Fox | 337/32 |
| 3,052,820 | 9/1962 | Kreekon et al. | 337/199 X |

*Primary Examiner*—Herman J. Hohauser
*Attorney, Agent, or Firm*—Guy E. Matthews

[57] ABSTRACT

In an electrical switch for making and breaking electric connection between an energized electric conductor and a de-energizable electric conductor that are separated by an insulator and are controllable through manipulation of a pivotably movable switch element, a grounding mechanism is provided for connecting the de-energizable electric conductor to ground potential in the open condition of the switch to pass any electric current that might flow through the insulator to ground in the event the insulator might have become defective for any reason to such extent that it allows passage of electric current therethrough. The grounding mechanism may include a grounding connector element that may be connected to ground through a suitable grounding conductor and may also include grounding contact means that establishes electrical contact with the grounding conductor element in the open position of the switch. The grounding contact means may conveniently take the form of a pair of blade elements that are physically supported by the movable switch element and which are connected in a suitable manner to the de-energizable conductor that is controlled through manipulation of the switch. Following movement of the movable switch element from its closed position, the grounding contact means, which may conveniently take the form of a pair of grounding contact blades may be received in friction retained engagement with the grounding contactor thereby establishing a conductor path from the insulator to ground potential and preventing accidental injury to any workman that might come into contact with the de-energizable conductor.

2 Claims, 3 Drawing Figures

ELECTRICAL SHORTING DEVICE

FIELD OF THE INVENTION

This invention relates generally to switch mechanisms such as might be employed to make and break electrical contacts between a pair of high voltage electrical current supply conductors. More particularly the invention is directed to the provision of a grounding mechanism for connecting the de-energizable electric conductor to ground potential in the open position of the switch mechanism thereby insuring grounding of any current flow that might exist across the conductor in the event the conductor should become defective to the point that a flow of current can pass therethrough.

BACKGROUND OF THE INVENTION

Electrical current is typically supplied to end users through high voltage transmission lines that typically are located on elevated structures above the surface of the earth. It is frequently necessary to de-energize a portion of the current transmission lines in order to allow workmen to conduct service operations under safe working conditions. To facilitate de-energization of only a portion of the electric transmission circuitry, there will be provided switching mechanisms that may be manipulated in such manner as to make and break the electrical connection between sections of each of the transmission conductors involved. For example, a branch conductor may be connected to a main line conductor through a simple switch mechanism, the main line and branch line being separated by an insulator with a switching mechanism that bridges the insulator when the switch mechanism is in the closed position thereof. Typically such switches are located on structure that is supported by elevated towers or poles the switches being manipulated by means of long insulated switch actuating rods that may be manipulated by workmen at ground level or located at a considerable distance from the switch devices being manipulated. By using one of these long rods, a workman can insert an actuating hook of the rod into an eye on the switch device and, by applying a downward force, and easily move the switch to its open position. Conversely, the workman can push the switch upwardly by means of the rod and can easily move the switch to its closed position to energize the branch conductor from the main line conductor. Typically the switch devices are of pivotal nature and are supported by pivot structure located at the lower extremity of the insulator structure. The switch mechanism includes an elongated movable element having a current conducting capability that is pivotally connected at one extremity thereof to the support structure and may be pivoted between open and closed positions relative to a switch plate that receives the free extremity of the elongated movable switch element in the closed position thereof. The switch plate is electrically connected with the main line conductor through suitable bracket structure. As mentioned above, each of the switches is opened by pulling downwardly on a switch actuating eye by means of an elongated insulated rod. Typically, the pivotal portion of the switch mechanism is allowed to pivot downwardly to a near vertical condition and to merely hang suspended from its support structure. In this condition, workmen can service electrical equipment connected to the de-energized branch conductor under safe operating conditions.

At times, an insulator can become conductive under certain conditions. For example, if lightning should strike the electrical equipment that provides support for the electrical transmission conductors, the insulator can be rendered conductive by the enormous amount of electrical potential that is placed across it by the electrical discharge of the lightning. This is a very infrequent occurance, but, when it does occur, a condition of electrical potential can be developed across the insulator, allowing the branch conductor to be energized even though the switch mechanism may be in the open position thereof. When insulators remain in service for extended periods of time, depending upon the operating circumstances involved, it is possible for an insulator to break down to the point that it becomes conductive. This also is a very infrequent occurance, but when it does occur, a very dangerous condition exists. It is therefore a primary object of the present invention to provide means for insuring grounding of branch conductors under conditions where a switching mechanism is in the open position thereof, thereby providing workmen servicing the branch conductors or any equipment connected thereto with safe working conditions.

It is also an important feature of the present invention to provide a novel switching mechanism for electrical conductors that includes means for maintaining a de-energized supply conductor under a condition of ground potential for extended periods of time to insure that any sudden application of electrical energy to a de-energized branch conductor is immediately transmitted to ground potential and does not present a hazardous condition for workmen that might be involved in servicing the branch conductor or its connected equipment.

Among the several objects and features of the present invention is noted the contemplation of a novel switching mechanism for electrical supply conductors that includes means for detecting the flow of high voltage current across an insulator to ground in order that a defective insulator may be located and replaced so as to eliminate a potentially hazardous condition.

It is also a feature of the present invention to provide a novel grounding mechanism for electrical switches that is of inexpensive nature, is reliable in use and low in cost.

Other and further objects, advantages, and features of the present invention will become apparent to one skilled in the art upon full consideration of the present disclosure. The form of the invention, which will now be described in detail, illustrates the general principals of the invention, but it is to be understood that this detailed description is not to be taken as limiting the scope of the present invention.

SUMMARY OF THE INVENTION

A preferred embodiment of the invention may conveniently take the form of a grounding connector blade element or other suitable electrical connector device that may be supported by any suitable structure, such as the cross-arm of an electrical utility pole. The grounding connector may be electrically connected to ground potential by a ground conductor that extends downwardly along the utility pole and is connected to a suitable grounding rod. A movable switch mechanism, that may be manipulated to achieve electrical connection and disconnection of a pair of transmission conductors, may be provided with an electrical grounding element that is disposed in electrical contact with conductor to be energized. The grounding contact element may be in the form of a pair of blade-like elements that receive the grounding contactor blade there between to establish electrical connection between the movable switch element and the conductor to be de-energized, thereby positively connecting the conductor to be de-energized to ground potential through the grounding conductor and the conductive structure connected thereto. The grounding conductor blades may be composed of electrically conductive spring material and may be urged one toward the other, thereby causing the blades to have retaining frictional engagement with the grounding connector blade and thereby causing the grounding circuit relationship to be maintained through such frictional engagement. In the event a more positive retention of the grounding circuit relationship is desired, a locking element such as a pin or bolt may be inserted through registering amperatures formed in the grounding connector blade and the grounding contact blade to prevent inadvertant disconnection of the grounding circuit.

BRIEF DESCRIPTION OF THE DRAWINGS

So that the manner in which the above recited features, advantages and objects of the present invention, as well as others which will become apparent, or attained and understood in detail, more particular description of the invention, briefly summarized above, may be had by reference to the embodiment thereof which is illustrated in the appended drawings, which drawings form a part of this specification.

It is to be noted however that the appended drawings illustrate only a typical embodiment of the invention and are therefore not to be considered limiting of its scope, for the invention may admit to other equally effective embodiments.

In the drawings:

Figure 1:
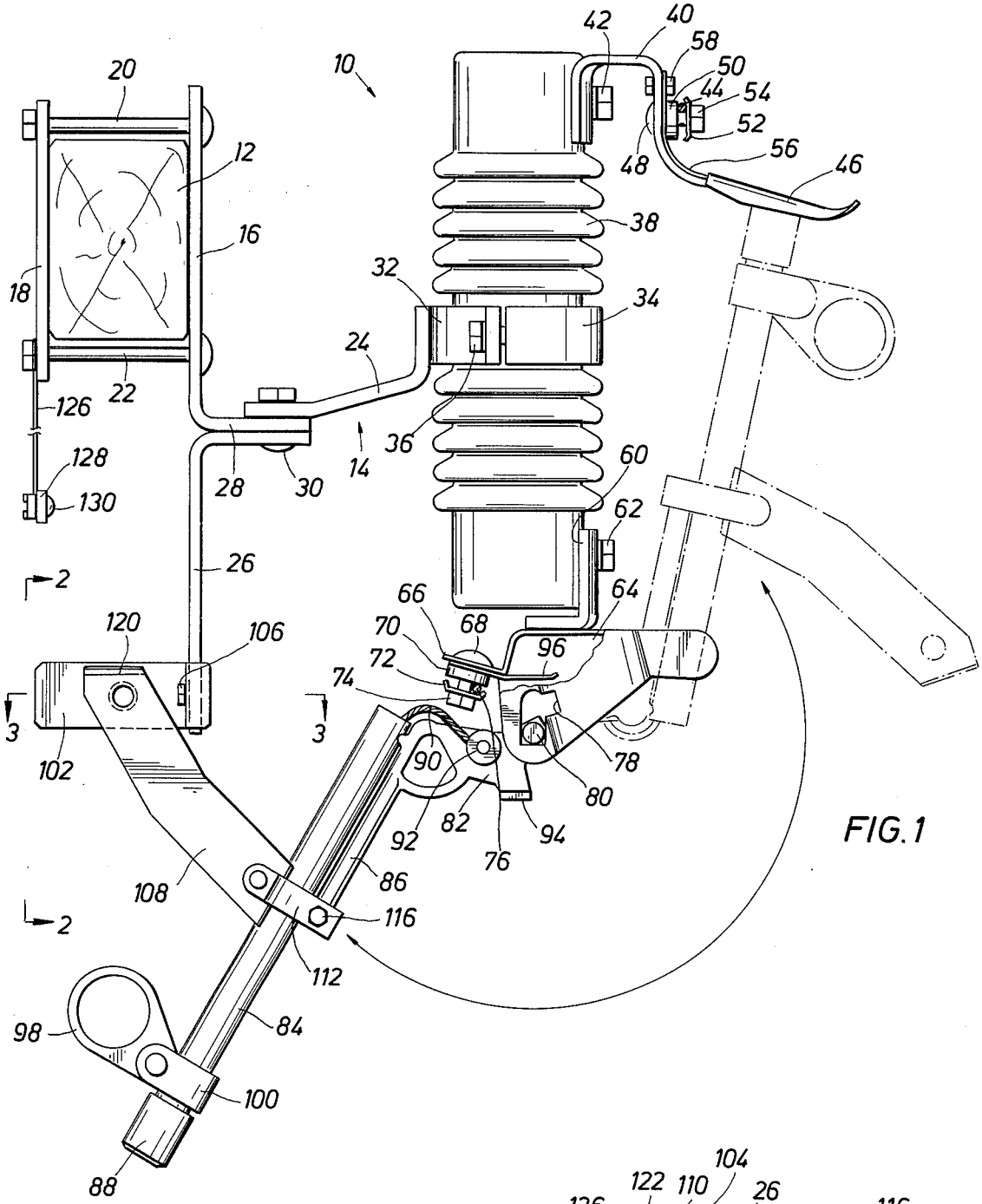

FIG. 1 is an elevational view of a switching mechanism for making and breaking an electrically connected relationship between a pair of electrical transmission conductors, which switching mechanism is shown in the open position thereof in full line and is shown in the closed position thereof in broken line and which switching mechanism further incorporates a mechanism for establishing connection between one of the transmission conductors and ground potential in the grounded position illustrated in full line.

Figure 2:
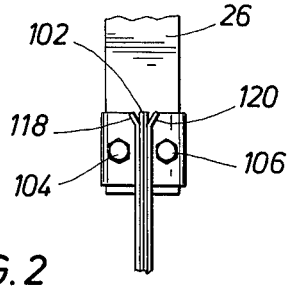

FIG. 2 is a fragmentary elevational view taken along line 2—2 in FIG. 1 and illustrating the relationship between the single bladed grounding connector structure and the double bladed grounding contact structure of the grounding circuit mechanism.

Figure 3:
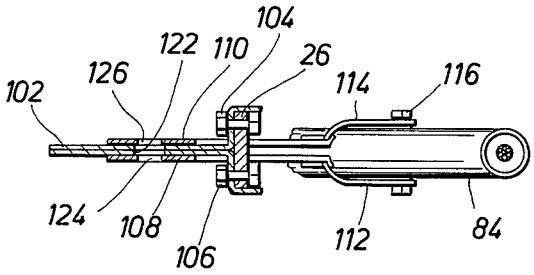

FIG. 3 is a sectional view taken along line 3—3 in FIG. 1 and representing a fragmentary section further illustrating the cooperative relationship between the single grounding connector blade and the double grounding contact elements.

DESCRIPTION OF PREFERRED EMBODIMENT

Referring now to the drawings and first to FIG. 1 an electrical switching mechanism is illustrated generally at 10 that is supported from the cross arm 12 of a utility pole by a support bracket structure illustrated generally at 14. The support bracket structure may incorporate a generally L-shaped structural element 16 and flat structural element 18 that are secured in assembly with the cross arm 12 by means of a pair of bolt elements 20 and 22. An insulator support arm 24 and a grounding connector support arm 26 may be secured to an outwardly extended lower portion 28 of the L-shaped structural element 16 by means of a bolt and nut assembly 30 or by any other suitable means of connection. To the insulator support arm 24 may be fixed an insulator support bracket 32 that may function in cooperative relationship with an insulator retainer bracket 34, held in assembly with the bracket 32 by means of bolts 36 or any other suitable means of connection for retaining an insulator element 38 is substantially immovable relationship with the cross arm structure of the utility pole. Obviously, the insulator support mechanism just described may be of any other suitable configuration as is appropriate for supporting an insulator in space relationship with other utility conductor structure.

At one extremity of the insulator 38 may be connected a conductor and switch plate support bracket 40 by means of a suitable bolt 42 that is of sufficient structural integrity to provide support for an electrical conductor 44 and a switch plate 46. Although conductor 44 may not be a main line conductor that is always energized, for purposes of the present invention it shall be considered to be continuously energized or "hot" in order to be distinguishable from the de-energizable conductor that is supported at the lower extremity of the conductor. To provide support for the conductor 44 a stud 48, which may conveniently take the form of simple carriage bolt, may be secured to the bracket 40 by means of a retainer element 50. A conductor retainer 52 may be received by the stud or bolt 48 and lock nut 54 may be tightened onto the bolt or stud to cause the retainer element to secure the conductor 44 in positive relationship with the bracket structure. To provide for efficient current flow from the switch plate 46 to the high voltage conductor 44, an electrical conductor 56 may extend along a portion of the support bracket and may be secured to the bracket structure 40 by means of a suitable nut and bolt assembly 58. A retainer element 50 may also be formed of a highly conductive material so as to provide optimal current flow from the conductor 44 to the switch plate 46.

At the lower extremity of the insulator 38 may be provided a generally L-shaped switch support bracket 60 that may be retained in assembly with the insulator by means of a suitable bolt 62. A conductor and switch support bracket 64 may be supported in any suitable manner by the switch support bracket 60 and may include a conductor support extension 66 that may receive a stud and retainer assembly 68 and 70 that functions in conjunction with a conductor retainer element 72 and nut 74 to retain a de-energizable conductor 76 in fixed engagement therewith. The bracket 64 may be formed to define a pair of opposed pivot openings such as shown in 78 for the purpose of retaining the pivot portion 80 of a pivotal support and connector structure 82, so as to establish a pivotal relationship between the bracket 64 and the pivotal structure 82.

An elongated switch bar 84 may be suitably connected to an elongated portion 86 of the pivotal element 82 and the bar 84 may be provided with a terminal brush head portion 88 that is adapted to move into friction received contacting relationship with the switch plate 46 upon pivoting of the switch bar 84 to the position illustrated in broken lines in FIG. 1. Electrical current passing through the conductive switch plate 46 to the brush head structure 88 may be conducted by means of a conductor element 90 to the pivotal switch element 82 with the conductor 90 being retained in assembly with the switch element by means of a retainer element 92 that may be bolted or otherwise attached to the pivotal element in any suitable manner. The conductor element 90 extends through the hollow switch bar 84 and is electrically connected with the brush head portion 88.

Electrical current flow through the switch mechanism effectively by-passes the pivot connection 80 that secures the pivotal element 82 to the bracket structure 64 by means of a contact element 94 on the pivotal element that moves into frictional engagement with a spring contact plate 96 of the bracket when the switch bar and pivot element are moved to the closed position thereof which is illustrated in broken line in FIG. 1.

To enable the switching mechanism to be rotated between the open and closed positions thereof, a manipulating eye structure 98 may be secured to the elongated switch bar 84 by means of a suitable bracket 100. A workman located a suitable distance from the switch mechanism may insert a hook on the end of an elongated insulated rod into the eye 98 of the switch bar 84 and may either pull the bar downwardly to cause the brush structure 84 to loose its frictional engagement with the switch plate 46, whereupon the switch bar is enabled to rotate along with the pivotal element 82 to a downwardly extended position. Conversely, the workman may also rotate the switch bar and pivot element to the broken line position by means of manipulation with the hook of the rod extended through the eye 98.

As mentioned above, it is desirable to provide a means for establishing connection between the de-energizable conductor 76 and ground potential. In accordance with the present invention, one suitable means for accomplishing this feature may conveniently take the form illustrated in FIGS. 1, 2, and 3 where a grounding connector blade 102 is shown to be connected to the grounding connector support element 26 by means of a pair of bolts 104 and 106 that may be threadedly received by the support element 26. The blade element 102 may be of single material thickness if desired, but as shown in FIGS. 1, 2, and 3, the blade element 102 and its support structure is formed by bending a strip of metal so that two generally planar portions are in side by side touching relationship while an intermediate portion of the strip is disposed in encircling relationship with the lower extremity of the grounding connector support element 26.

A grounding contact element for establishing electrical contact between the conductive extending portion 86 of the pivotal element 82 may include a pair of blade elements 108 and 110 that are adapted to receive the grounding connector blade 102 and frictional and electrical contacting relation therebetween. The blade elements 108 and 110 may be supported by connector elements 112 and 114 that may be secured to the extending portion 86 of the pivotal element 82 by means of bolt and nut assembly 116. In the absence of the presence of the grounding connector blade between the blade elements 108 and 110, the blades 108 and 110 may be disposed in touching or almost touching relationship. The blades may be provided with outwardly bent extremities, such as shown at 118 and 120 in FIG. 2 to facilitate a camming action that spreads the blades upon engagement thereof with the grounding connector blade element 102, thereby allowing the connector blades 102, 108, and 110 to be movable into electrically contacting relationship. The blade elements 108 and 110 will be slightly moved apart upon insertion of the blade element 102 therebetween, thereby causing a fairly tight frictional relation ship to be established therebetween which enhances the electrical contacting relationship that is also established.

It may also be desirable to provide means for retaining the blade elements 102, 108, and 110 in intimate engaging and electrically contacting relationship, and according to the present invention, this may be conveniently accomplished simply by forming an aperature 122 in blade element 102 that may be disposed in registry with aperatures 124 and 126 defined in blade elements 108 and 110 respectively. A retainer pin, bolt, or other suitable object may be inserted through the registering aperatures to provide sufficient structural support to prevent the blade elements from becoming disassembled inadvertently.

To establish electrical connection between the grounding connector blade element 102 and ground potential, a grounding conductor 126 may be secured to the cross-arm support bracket structure by the bolt 22 as shown in FIG. 1. The lower extremity of the grounding conductor 126 may be secured to a ground rod 128 that extends into the earth, by means of a suitable connector bracket 130. Thus, any electrical current that may be capable of flowing through the insulator 38 in the open position of the switch structure rather than energizing the de-energizable conductor 76, will flow through the bracket 64, the pivotal element 82–86 and to the grounding contact blade elements through the connector elements 112 and 114. Any current flow reaching the grounding connector blade element 102 will flow through the support bracket 26–28 to the bolt 22 and then to the grounding conductor 126 and to the ground rod 128.

As mentioned above, it is desirable to provide a means for detecting any massive current flow that might have occurred through the insulator element 38 while the switch mechanism is positioned as shown in full line in FIG. 1. Since the flow of current must pass across the pivotal connection establishing the pivotal relationship between pivot element 82 and the bracket structure 64, the current, under typical electrical transmission potential, may cause the metal the the pivot to be welded, thereby preventing the switch bar and pivot from being rotated away from the grounding position thereof without first breaking the weld that has occurred. Moreover, when welding occurs at the pivot, there will likely be visible electrical sparks that will provide a visual indication that welding has occurred under a condition that should produce no current flow at all if the insulator is providing proper protection. If this happens when the switch is in the open condition thereof, it is logical to suspect that the insulator has broken down and become conductive and therefore steps should be taken to replace it.

From the foregoing, it is clearly apparent that a novel grounding mechanism has been provided for a conductor switch mechanism that insures against the development of a hazardous condition to working personnel in the event an insulator across the switch element should become broken down for any reason whatever to the point that it becomes conductive. Any current flow that exists under this condition will go immediately to ground and will materially reduce if not eliminate any circumstance where a de-energizable conductor becomes energized across an insulator and presents a hazard. Moreover, a high current voltage flow across the conductor may provide welding of a pivot structure and may provide sparks as an indication that an insulator malfunction has occurred. The invention therefore is one well adapted to attain all of the features and advantages hereinabove set forth, together with other advantages which will become obvious and inherent from a description of the apparatus itself. It will be understood that certain combinations and sub-combinations are of utility and may be employed without reference to other features and subcombinations. This is contemplated by and is within the scope of the present invention.

As many possible embodiments may be made of this invention without departing from the spirit or scope thereof, it is to be understood that all matters hereinabove set forth or shown in the accompanying drawing are to be interpreted as illustrative and not in a limiting sense.

What is claimed is:

1. A safety switch for an electrical transmission line and for assuring repairmen that said line is safely deenergized for enabling such repairmen to perform work upon such transmission line, said switch being adapted to be mounted relative to a utility pole for supporting said transmission line, the invention comprising:

a. An insulator for receiving said transmission line;

b. Said transmission line being formed of first and second conductors with said insulator being mounted therebetween;

c. Means mounted at each end of said insulator for electrically connecting said conductors with said insulator;

d. Grounding means mounted adjacent said insulator with the utility pole;

e. A conductor bar pivotally and electrically connected with one of said means for electrically connecting said insulator, said conductor bar being pivotal to a first position which electrically connects said conductors to each other to form said transmission line for conducting of electricity therethrough being pivotal to a second position for contact with said grounding means to completely ground said transmission line to enable workmen to safely repair and work on said transmission lines.

2. The structure as set forth in claim 1 including a releasable retainer means mounted with said grounding means for frictionally and positively retaining said conductor bar until mechanically moved and pivoted away from said grounding means.

* * * * *